US008365959B2

(12) United States Patent
Tavolazzi

(10) Patent No.: US 8,365,959 B2
(45) Date of Patent: Feb. 5, 2013

(54) DEVICE FOR DISPENSING DRINKS THAT CAN BE ASSOCIATED WITH A SINK

(75) Inventor: Stefano Tavolazzi, Verbania-Intra (IT)

(73) Assignee: Whirlpool Corporation, Benton Harbor, MI (US)

( * ) Notice: Subject to any disclaimer, the term of this patent is extended or adjusted under 35 U.S.C. 154(b) by 949 days.

(21) Appl. No.: 12/031,991

(22) Filed: Feb. 15, 2008

(65) Prior Publication Data

US 2008/0217358 A1 Sep. 11, 2008

(30) Foreign Application Priority Data

Feb. 16, 2007 (IT) ..... VA20070011 U

(51) Int. Cl.

| | |
|---|---|
| ***B67D 7/06*** | (2010.01) |
| ***B67D 7/78*** | (2010.01) |
| ***B65D 88/54*** | (2006.01) |
| ***A62C 31/02*** | (2006.01) |

(52) U.S. Cl. ..... 222/144.5; 222/331; 222/132; 222/129.4; 239/25; 239/397

(58) Field of Classification Search ..... 222/129.1, 222/144.5, 144, 130, 132, 133, 642, 145.1, 222/145.5, 145.6, 185.1, 129.2, 129.3, 129.4, 222/501, 518, 331; 4/675, 676, 677, 678, 4/601, 623; 137/597, 594, 595; 251/129.04; 239/11, 12, 24, 25, 397

See application file for complete search history.

(56) References Cited

U.S. PATENT DOCUMENTS

| | | | | |
|---|---|---|---|---|
| 2,937,792 | A * | 5/1960 | Firstenberg | 222/144.5 |
| 3,144,967 | A * | 8/1964 | McClain | 222/144.5 |
| 3,168,967 | A * | 2/1965 | Giampa | 222/129.1 |
| 3,241,720 | A * | 3/1966 | Barney | 222/23 |
| 3,830,405 | A * | 8/1974 | Jaeger | 222/129.3 |
| 4,005,804 | A * | 2/1977 | Dreibelbis | 222/144.5 |
| 4,077,545 | A * | 3/1978 | Karls | 222/144.5 |
| 4,314,673 | A * | 2/1982 | Rudelick | 239/443 |
| 4,651,862 | A * | 3/1987 | Greenfield, Jr. | 194/344 |
| 4,673,108 | A * | 6/1987 | de Man | 222/144.5 |
| 4,732,300 | A * | 3/1988 | Valiyee et al. | 222/144.5 |
| 4,921,140 | A * | 5/1990 | Belcham | 222/144.5 |
| 5,056,686 | A * | 10/1991 | Jarrett | 222/129.2 |
| 6,003,170 | A * | 12/1999 | Humpert et al. | 4/623 |
| 6,457,191 | B2 * | 10/2002 | Brandebusemeyer et al. | 4/678 |
| 7,334,599 | B2 * | 2/2008 | Shieh | 137/119.05 |
| 7,343,930 | B2 * | 3/2008 | Rosko | 137/597 |
| 7,607,449 | B2 * | 10/2009 | Herring et al. | 137/15.18 |
| 7,721,761 | B2 * | 5/2010 | Thomas | 137/597 |
| 7,770,244 | B2 * | 8/2010 | Yeh | 4/675 |
| 2004/0060109 | A1 * | 4/2004 | Hensley | 4/675 |
| 2004/0217130 | A1 * | 11/2004 | Kado et al. | 222/129.1 |

* cited by examiner

*Primary Examiner* — Kevin P Shaver

*Assistant Examiner* — Stephanie E Williams

(74) *Attorney, Agent, or Firm* — Kirk W. Goodwin; McKee, Voorhees & Sease PLC

(57) ABSTRACT

A drink dispensing tap water dispenser, kit and method of converting a tap water dispenser to a drink dispenser is disclosed. The dispenser includes an adaptor having a central body portion connectable inline to a domestic tap water dispenser. A dispensing nozzle is supported by the central body portion of the adaptor and includes at least one liquid connection to a liquid source for dispensing liquid separate from the tap water dispenser.

15 Claims, 4 Drawing Sheets

DEVICE FOR DISPENSING DRINKS THAT CAN BE ASSOCIATED WITH A SINK

BACKGROUND OF THE INVENTION

1. Field of the Invention

The present invention has as its subject-matter a device suitable for dispensing drinks and liquid substances in general, and particularly drinks that are carbonated or still, hot or cold, syrups, or even steam.

The state of the art offers drinks dispensers similar to ordinary taps or particular devices called "gun dispensers" used for professional applications in bars and restaurants.

2. Description of the Related Art

In general, known devices suitable for dispensing drinks are very expensive and do not lend themselves easily to domestic applications.

Currently the application of a device suitable for dispensing drinks in a domestic setting means that the user needs to drill the surface of a kitchen sink or worktop, an operation that is not always easy without using skilled labour. Another possibility is to replace an existing tap in a domestic setting, connected to the hot and cold water pipes coming from the outside, by a new device suitable for dispensing drinks, therefore abandoning the traditional use of the tap associated with the sink.

SUMMARY OF THE INVENTION

The aim of the present invention is to provide a device suitable for dispensing drinks and liquid substances in general in a domestic setting substantially without modifying the arrangement and use of existing taps and without the need to create additional holes.

A typical tap for dispensing water, known per se, comprises a central cylindrical body to which a device for dispensing the flow is connected, at one end of which an aerator is placed, or even a manual flow regulator suitable for selecting and mixing the flow of hot and cold water. These taps are usually installed on a sink surface, typically made of metal or ceramic or on masonry or wooden surfaces using fixing means, typically threaded. The installation of such a device therefore requires the presence of a hole for inserting the device on the support surface.

The present invention concerns a device that can easily be connected to any tap known per se as just described.

This aim is achieved by means of a device having the characteristics specified in the attached claims.

A non-restrictive example of installation of the device according to the invention comprises the following phases: disassembling the current tap and inserting the lower part of the central body of the device according to the invention into the hole now made available; and finally, mounting the tap previously removed in the upper part of the central body of the device.

The connection between the central body of the device according to the invention and the device for dispensing the flow of liquid can be fixed or mobile and can comprise a system suitable for sliding relative to the device for dispensing the flow of liquid with respect to the central body with the aim of allowing greater flexibility of use thereof.

An example embodiment of the device according to the invention can provide for the central body to be connected to two or more devices for dispensing the flow of liquid.

A further example embodiment of the device according to the invention provides for an electronically controlled device comprising a plurality of push-buttons suitable for selecting the dispensing of a plurality of available drinks or liquid substances placed on the outer wall of the central body or on the body for regulating and mixing the flow of liquid.

The device suitable for selecting and dispensing the type of drink can also comprise a device for regulating the temperature of drinks to be dispensed.

The electronically controlled device can comprise a user interface ("display") capable of informing the user of the characteristic operating parameters of the device (for example the temperature of the drinks dispensed, an indicator of the number of drinks available, a water filter life indicator, or even an indicator of carbon dioxide pressure in a cylinder used for carbonating water or drinks).

The electronically controlled device suitable for selecting and dispensing the type of drink can be of the "RF wireless" type, further simplifying the assembly and appropriate water/electrical connection of the tap.

BRIEF DESCRIPTION OF THE DRAWINGS

Further advantages and characteristics of a device according to the invention will become obvious from the following detailed description, provided purely by way of non-restrictive example, in which.

DETAILED DESCRIPTION OF THE PREFERRED EMBODIMENTS

Figure 1:
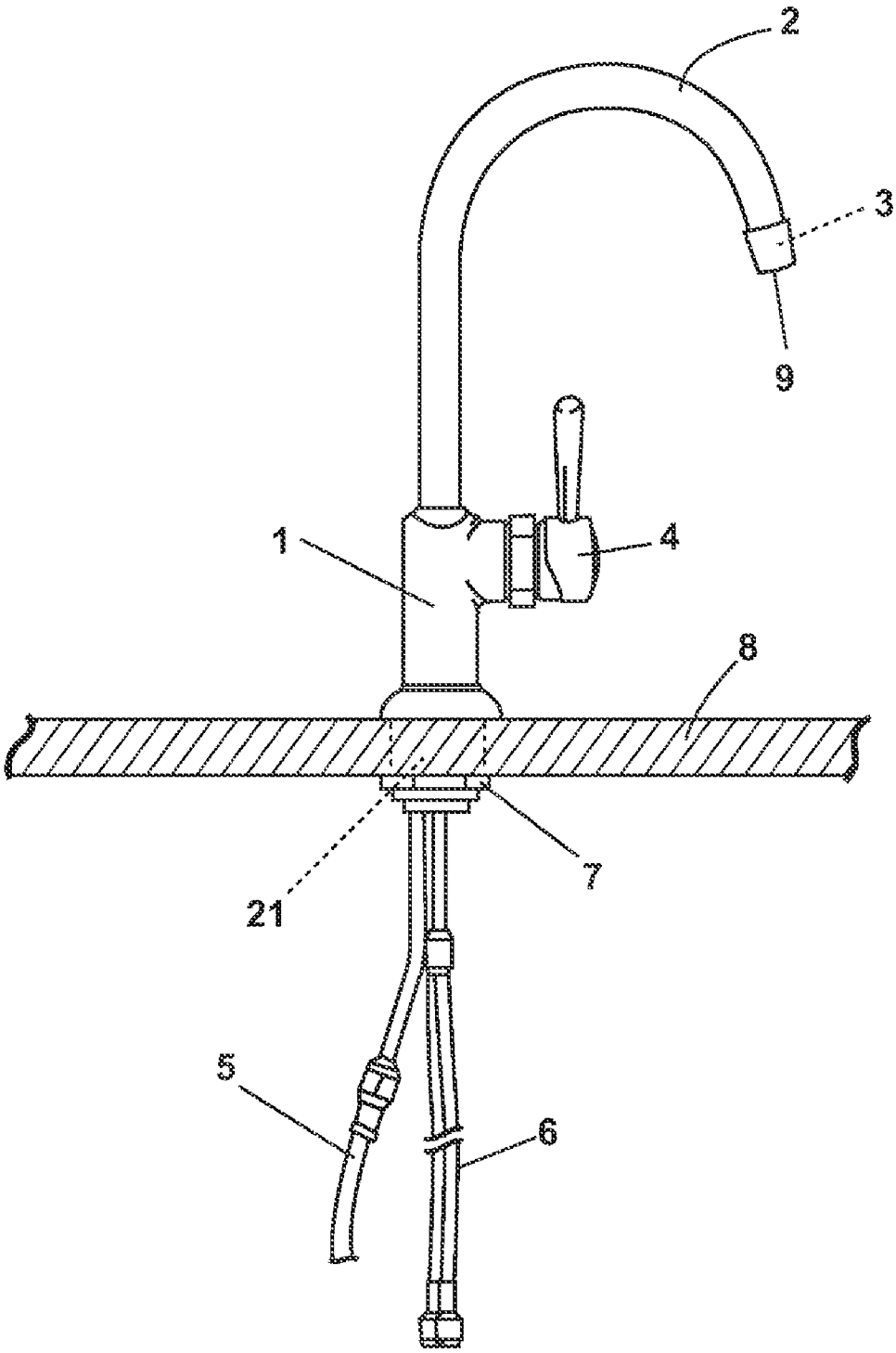
FIG. 1 is a side view of a typical tap for domestic use, known per se.
Figure 3:
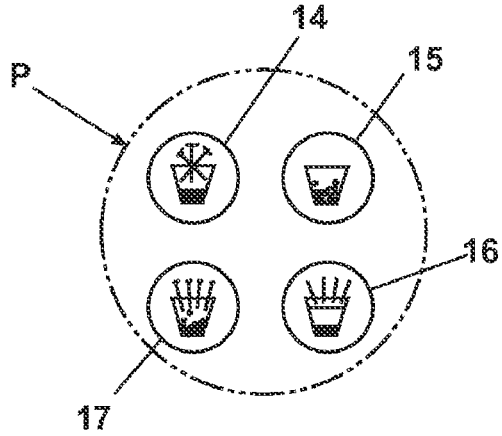
FIG. 3 is a detail, on a larger scale, from FIG. 2.

FIG. 1 illustrates a typical tap for a sink, comprising a central body (1), to which a device for dispensing the flow (2) is connected, at the ends of which are arranged an aerator (3), a flow regulator (4) suitable for selecting and mixing the flow of hot and cold water coming from outside, a pipe (6) connected to a municipal distribution network and a pipe (5) connected to an external device suitable for heating the water. The water is then dispensed from the nozzle (9). The central body (1) is inserted into a hole (21) provided on a kitchen worktop (8) and is fixed to the latter by means of a threaded bushing (7).

Figure 2:
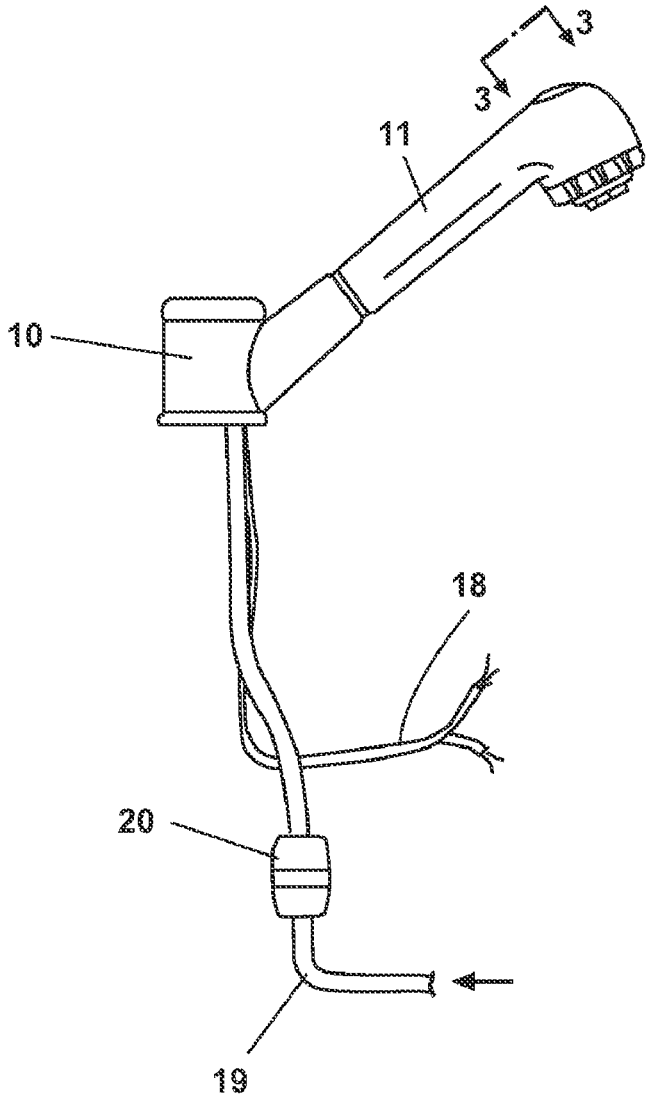
FIG. 2 is a diagrammatic side view of a device according to the invention.

FIG. 2 illustrates the device according to the invention comprising a central body (10), a device for dispensing, regulating and mixing the flow of liquid (11), a electrical cable (18), a connection, by means of a duct, to a source of liquid substances (19), a balancing device (20) suitable for facilitating the insertion of the device for dispensing the flow of liquid into the central body (10) in a phase of non-use, an electronically controlled device comprising a plurality of push-buttons (P) suitable for selecting the dispensing of a plurality of available drinks or liquid substances, for example cold mineral water (key 14), carbonated drinks (key 15), hot infusions (key 16), steam (key 17). Dispensing steam is particularly useful for cleaning dishes.

Figure 4:
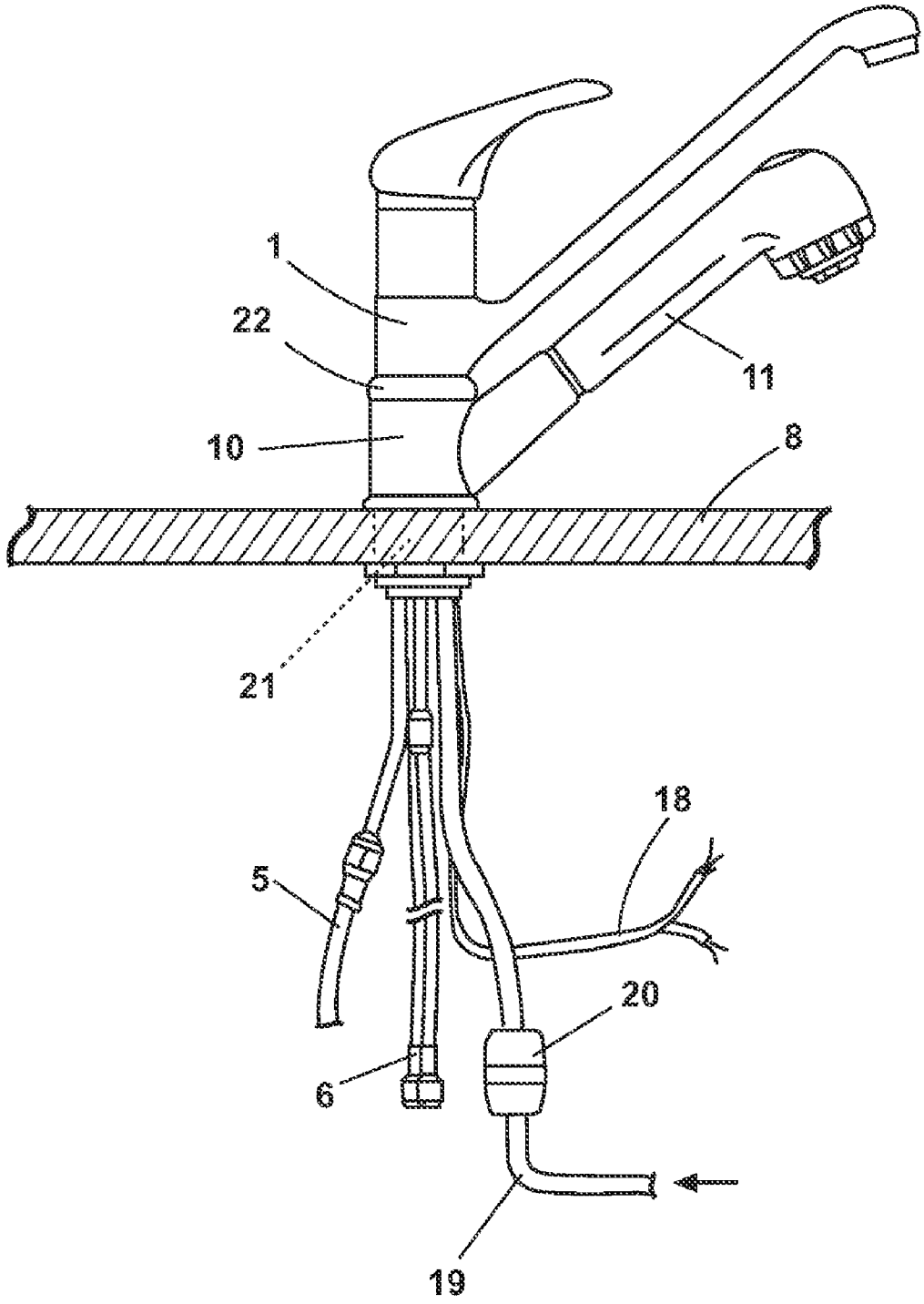
FIG. 4 is a view that illustrates a way of connecting the device in FIG. 2 and a typical tap known per se.

FIG. 4 illustrates a way of connecting the device in FIG. 2 and a typical tap known per se, in which connection by means of the duct (19) to the source of liquid substances is independent of the pipes (5) and (6). The relative rotation between the body (1) of the tap and the central body (10) of the device according to the invention is guaranteed by the interposition of a ring (22) made of antifriction material (for example polyamide).

Figure 5:
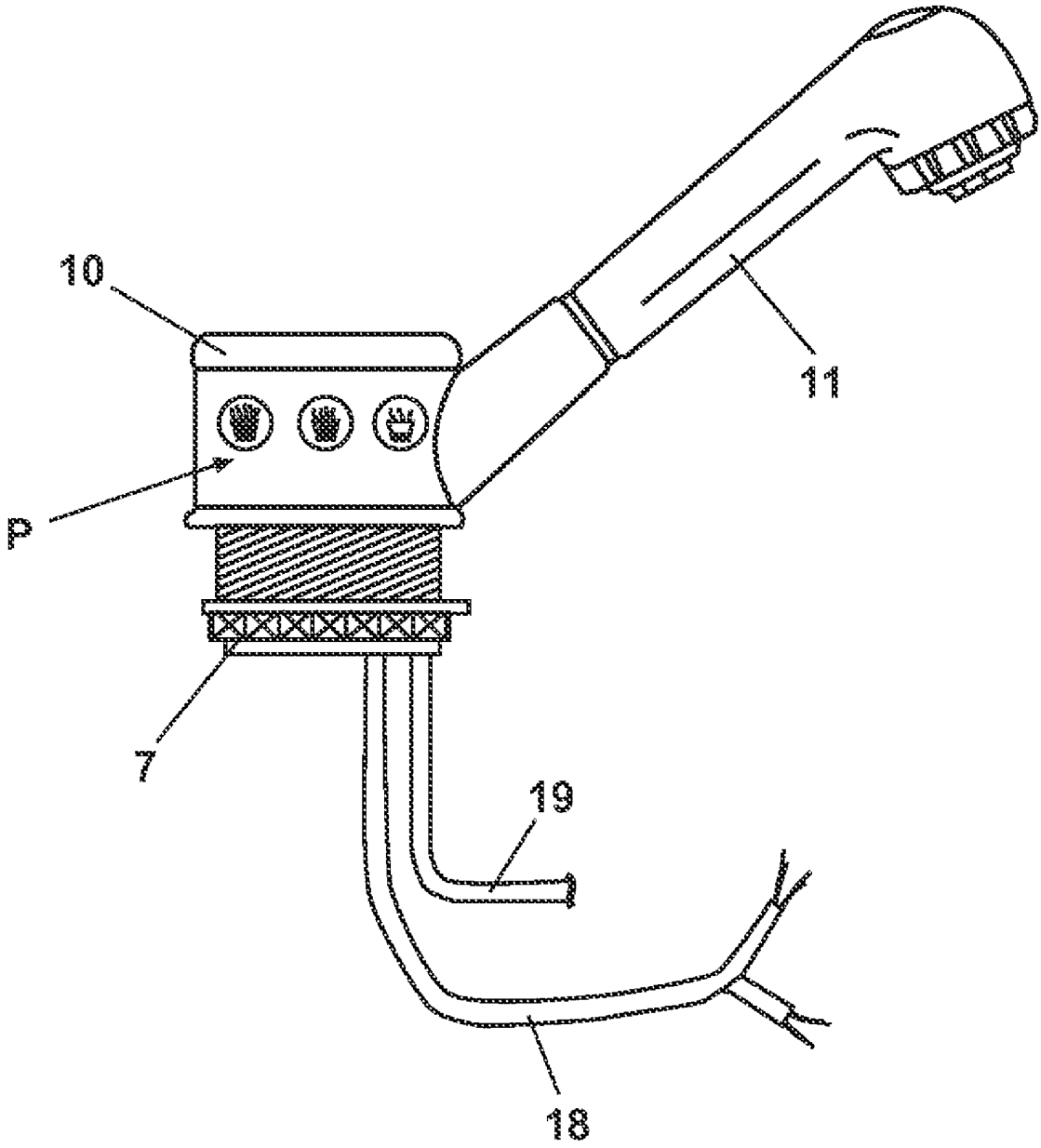
FIG. 5 is a view of a variant of the device according to the invention.

FIG. 5 illustrates a configuration of the device, in which the push-buttons P suitable for selecting and dispensing the type of drink are placed on the side wall of the central body (10).

I claim:

1. A drink dispensing tap water dispenser comprising:

a tap water dispenser having an inlet connected in fluid communication with a water source and a body with a flow regulator, the body having a spout for discharging water from the source;

a device having a central body portion connected inline to the dispenser body, wherein the central body portion of the device includes a user interface having a liquid type selector; and a dispensing nozzle supported by the central body portion and having at least one liquid connection to a liquid source for dispensing liquid from the liquid source through the dispensing nozzle separate from water dispensed through the tap water dispenser spout.

2. The tap water dispenser of claim 1 wherein the dispensing nozzle is removably received within the central body portion on the tap.

3. The tap water dispenser of claim 2 wherein the dispensing nozzle includes a user interface having a liquid type selector.

4. The tap water dispenser of claim 3 wherein the liquid type selector includes a plurality of depressible buttons.

5. The tap water dispenser of claim 1 wherein the dispensing nozzle includes at least one electronic connection to the liquid source for communicating a control signal from a user interface on the nozzle.

6. The tap water dispenser of claim 1 wherein the dispensing nozzle includes an RF wireless transmitter for communicating a control signal to the liquid source.

7. The tap at dispenser of claim 1 wherein at one of the liquid sources comprises steam.

8. A drink dispensing tap water dispenser comprising:

a tap water dispenser having a body with a spout terminating in an outlet connected in fluid communication with a water source;

a drink dispensing nozzle supported by the body of the tap water dispenser; and the drink dispensing nozzle having a beverage line connected in fluid communication to a consumable beverage source for dispensing a consumable beverage separate from the water.

9. The dispenser of claim 8 having a first end connected to a mounting surface and a second end terminating in a flow regulator.

10. The dispenser of claim 8 wherein the drink dispensing nozzle is connected inline to the body between the first and second ends.

11. The dispenser of claim 8 wherein the body of the tap water dispenser includes a central body portion adapted to removably receive the drink dispensing nozzle.

12. The dispenser of claim 9 wherein the drink dispensing nozzle includes a beverage type selector.

13. The dispenser of claim 12 wherein;

a) operation of the flow regulator controls the discharge of water from the spout; and b) operation of the beverage type selector controls discharge of the consumable beverage from the drink dispensing nozzle.

14. A drink dispensing tap water dispenser comprising:

a tap water dispenser having a body with a first end adapted for mounting and a second end having a flow regulator;

a spout connected to the body and in fluid communication with a tap water source;

a drinks dispensing device removably supported by a central portion of the body;

a nozzle of the device connected in fluid communication with a plurality of consumable liquid sources;

a liquid source selector for selecting one of the plurality of consumable liquid sources for dispensing liquid from the consumable liquid source through the nozzle separate from water dispensed through the spout.

15. A drink dispensing tap water dispenser comprising:

a tap water dispenser having, an inlet connected in fluid communication with a water source and a body with a flow regulator, the body having a spout for discharging water from the source;

a device having a central body portion connected inline to the dispenser body;

a dispensing nozzle supported by the central body portion and having at least one liquid connection to a liquid source for dispensing liquid from the liquid source through the dispensing nozzle separate from water dispensed through the tap water dispenser spout; and wherein at least one of the liquid sources comprises steam.

* * * * *

UNITED STATES PATENT AND TRADEMARK OFFICE

CERTIFICATE OF CORRECTION

PATENT NO. : 8,365,959 B2
APPLICATION NO. : 12/031991
DATED : February 5, 2013
INVENTOR(S) : Stefano Tavolazzi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1073 days.

Signed and Sealed this
Eighteenth Day of November, 2014

Michelle K. Lee

Michelle K. Lee
*Deputy Director of the United States Patent and Trademark Office*